US006244063B1

(12) United States Patent
Yates

(10) Patent No.: US 6,244,063 B1
(45) Date of Patent: Jun. 12, 2001

(54) REFRIGERATION WALL SYSTEM

(75) Inventor: Gaylon O. Yates, Parsons, TN (US)

(73) Assignee: Manitowoc Foodservice Group Inc., Sparks, NV (US)

( * ) Notice: Subject to any disclaimer, the term of this patent is extended or adjusted under 35 U.S.C. 154(b) by 0 days.

(21) Appl. No.: 09/417,267

(22) Filed: Oct. 12, 1999

(51) Int. Cl.[7] ..... F25D 23/12
(52) U.S. Cl. ..... 62/259.1; 62/297
(58) Field of Search ..... 62/259.1, 297

(56) References Cited

U.S. PATENT DOCUMENTS 3,006,167 * 10/1961 Lorch ..... 62/515
3,205,674 * 9/1965 Arnold et al. ..... 62/259.1
3,729,950 * 5/1973 Astrom ..... 62/259
5,245,838 * 9/1993 Cavalea, III ..... 62/259.1
5,546,758 * 8/1996 Hintermeier ..... 62/259.1
5,775,119 * 7/1998 Yamada et al. ..... 62/259.1
5,966,956 * 10/1999 Morris et al. ..... 62/259.1
6,109,052 * 8/2000 Austin, Jr. ..... 62/259.1

* cited by examiner

*Primary Examiner*—William Doerrler
*Assistant Examiner*—Mark Shulman
(74) *Attorney, Agent, or Firm*—Brinks Hofer Gilson & Lione

(57) ABSTRACT

A refrigeration wall system including interlocking panels having fastening mechanisms coated with a backing material, and a method for making the fastening mechanisms. The fastening mechanisms are embedded within insulating material inside of the interlocking panels. The backing material improves the adherence of the fastening mechanisms to the insulating material and thereby increases the overall strength of the refrigerator wall system.

20 Claims, 4 Drawing Sheets

REFRIGERATION WALL SYSTEM

FIELD OF THE INVENTION

The present invention relates to a refrigeration wall system composed of interlocking panels. More specifically, the present invention relates to a refrigeration wall system having panel fasteners that are coated with a backing material that enhances the adherence of the fasteners to the panel's foam insulation.

BACKGROUND OF THE INVENTION

Certain types of walls, such as refrigerator walls, are assembled from insulated slab panels, which are factory molded from insulating materials such as urethane. Mounted within these panels are fastening housings for holding adjacent slabs in abutting positions as they are assembled. The fastening housings contain opposed locking devices. Usually the housings are mounted along the panel edges during the factory molding process, and thus the housings must adhere to the molding material in order to provide a secure interlocking of the panels.

One obstacle in the manufacture of refrigeration wall systems has been poor adherence of the metal fastener housings to typical insulating material such as urethane foam. In the past, this problem has been addressed by spraying the fastener housings with an adhesive before beginning the molding process in order to enhance the adherence of the fastener in the foam insulating material. This method did increase the pull strength of the foamed-in-place fastener, but proved to be labor intensive and costly. An alternative method was to apply the adhesive during the manufacture of the fasteners, but the adhesive tended to obstruct the equipment used to assemble the fasteners. Therefore, there continues to be a need for a fastener that will strongly adhere to the insulating foam in a refrigerator wall system while being easily produced and attached to the panels.

BRIEF SUMMARY OF THE INVENTION

Accordingly, it is an object of the present invention to provide a refrigerator wall system having panel fastening mechanisms with increased adherence to panel insulation, resulting in improved pull-strength and overall stability of the wall system.

It is a further object of this invention to provide a cost effective fastening mechanism for use in the refrigerator wall system that will not interfere with other processing equipment.

It is still another object of this invention to provide a method for making the fastening mechanisms for use in the refrigerator wall system.

To achieve these objectives, the present invention provides a refrigerator wall system having panel fastening mechanisms that are coated with a backing material. The backing material more strongly adheres to the insulating material than does the bare substrate of the fastener housing, and thus the backing material enhances the strength of the interlocking panels that constitute the refrigerator walls.

In one aspect of the invention, the backing material is a polymer. In another aspect of the invention, the backing material is a polyester.

In the method of the present invention, a backing material is added to a substrate material before the substrate is stamped to form the parts needed to assemble the fastening housings. The substrate is preferably a metal, and most preferably bare cold rolled steel, temper #4 with hardness range of B45 to B65. The backing material chosen must have a stronger adherence to insulating material than the substrate itself has to the insulating material. Suitable backers are polymers, such as polyesters, and/or epoxy resins.

The invention will be more clearly understood from the following description of the specific embodiment of the invention, together with the accompanying drawings.

DETAILED DESCRIPTION OF THE INVENTION

Figure 1:
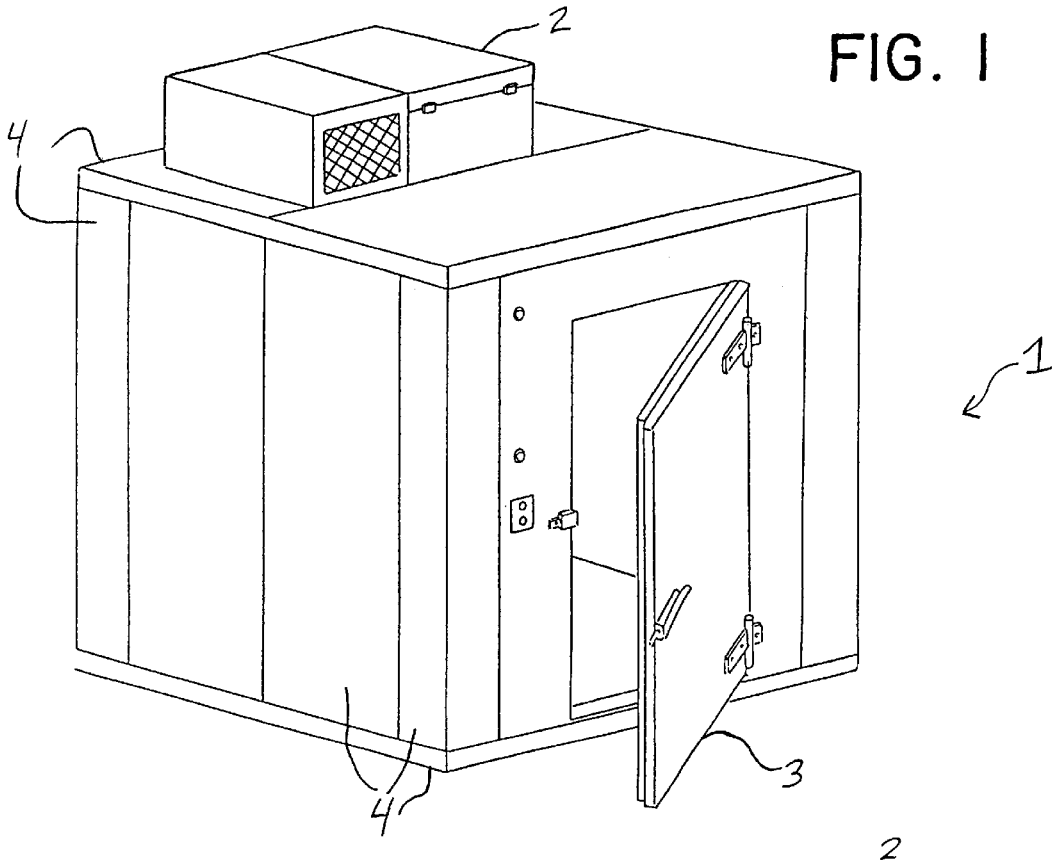
FIG. 1 is a perspective view of the front of the refrigerator of the present invention.

Referring now to the accompanying drawings and initially to FIG. 1, a refrigeration system in accordance with one preferred embodiment of the present invention is generally indicated in its totality at 1. In the preferred embodiment, the refrigeration system is a "walk-in" refrigerator. However, the present invention is useful with other known refrigeration systems. The refrigerator includes a refrigeration unit 2, an access door 3, and a plurality of interlocking panels 4. The locations and arrangement of the refrigeration unit 2, the access door 3, and the panels 4 are exemplary and are not meant to limit the scope of the invention. For example, one skilled in the art would recognize that the refrigeration unit 2 could be side mounted, and the access door 3 could be mounted on other portions of the panels.

Figure 2:
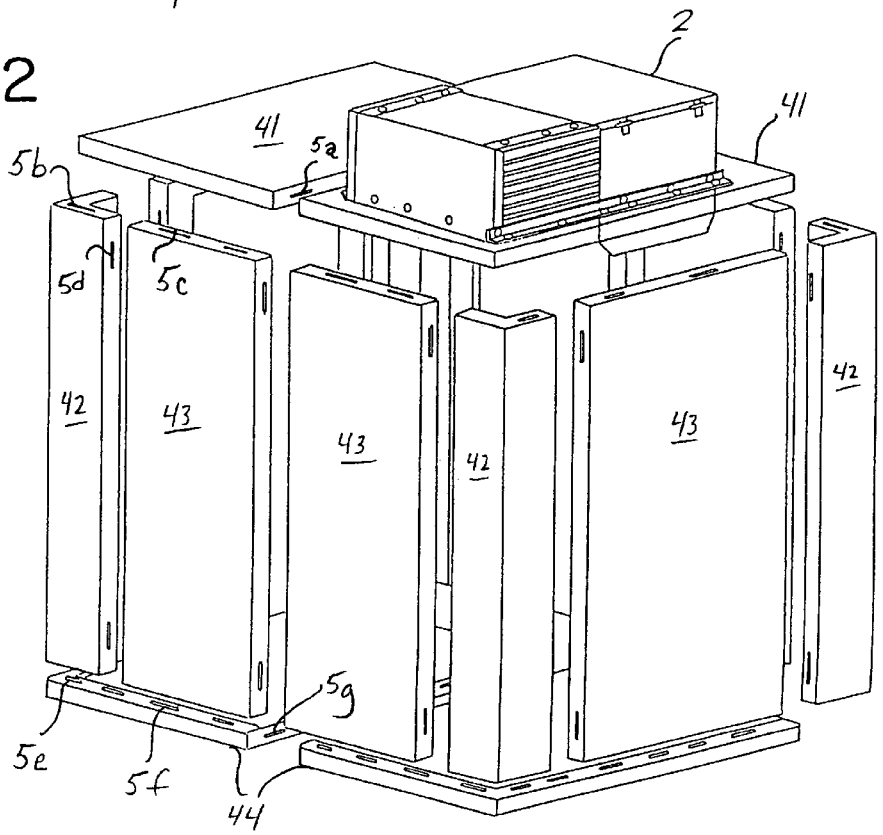
FIG. 2 is a rear exploded view showing the individual panels of the refrigerator of FIG. 1.

FIG. 2 shows a rear exploded view of the refrigerator system 1 of FIG. 1. In FIG. 2, the panels 4 are exploded to illustrate how the panels are interlocked in order to form the refrigerator wall system. Ceiling panels 41 support refrigeration unit 2. Ceiling panels 41 are attached to each other via fastening housings (not shown in FIG. 2) at fastener positions 5*a*. Likewise, ceiling panels 41 are also attached to corner panels 42 and wall panels 43 at fastener positions 5*b* and 5*c*, respectively. Corner panels 42 are attached to wall panels 43 at fastener position 5*d*, and both the corner panels 42 and the wall panels 43 are attached to floor panels 44 at fastener positions 5*e* and 5*f*, respectively. Similarly, floor panels 44 are attached to each other via fasteners at fastener positions 5*g*.

Figure 3:
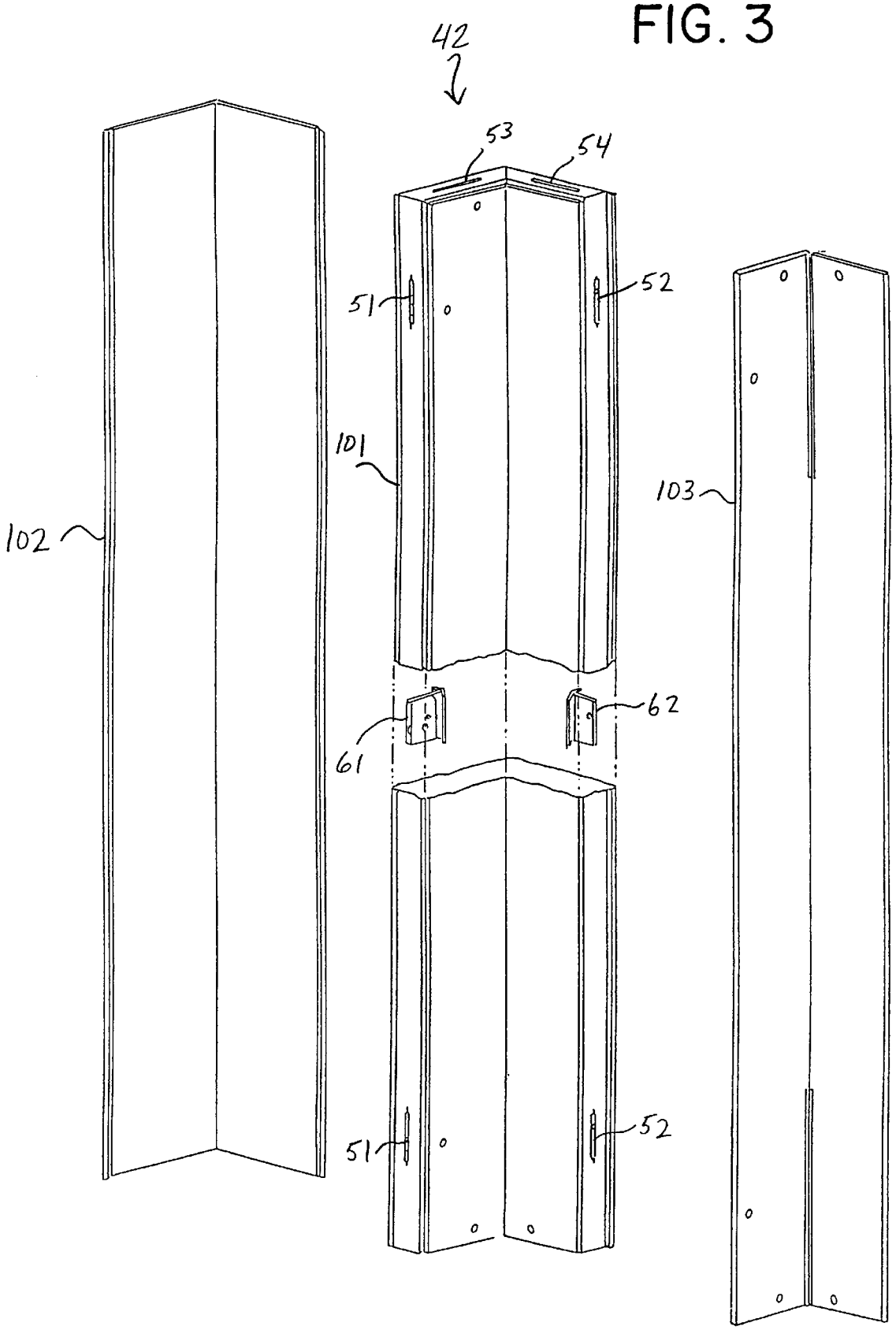
FIG. 3 is an exploded view showing the relation of the corner panels of the refrigerator with the fastening mechanisms of the present invention.

FIG. 3 is an exploded view of one of the corner panels 42. FIG. 3 shows the construction of the corner panels 42, as well as illustrates the positioning of the male fastening housings 61 and female fastening housings 62 within the corner panel 42. Comer panels 42 are formed by a molding process in which insulating material 101 is molded between metal skins 102, 103. The metal skins 102, 103 are preferably made from aluminum, stainless steel, or galvanized steel, and may have a mold bond adhesive (not shown) on their inner surfaces in order to secure the insulating material 101. Male fastening housings 61 and female fastening housing 62 are placed between the metal skins 102, 103 in male fastening positions 51, 53 and female fastening positioning 52, 54, respectively, and molded in place during the molding process. Each male fastening housing 61 engages a female fastening housing on an adjacent abutting panel, and likewise each female fastening housing 62 engages a male fastening housing on an adjacent abutting panel. Thus, male fastening housings 61 positioned at male fastening positions 51 engage and connect to a female fastening housings on a wall panel 43 (FIG. 2), while male fastening housings 61 positioned at male fastening position 53 engage and connect to female fastening housings of a ceiling panel 41 (FIG. 2). Likewise, female fastening housings 62 positioned at female fastening positions 52 engage and connect to a male fastening housings on a wall panel 43 (FIG. 2), while female fastening housings 62 positioned at female fastening position 54 engage and connect to male fastening housings of a ceiling panel 41 (FIG. 2).

Figure 4:
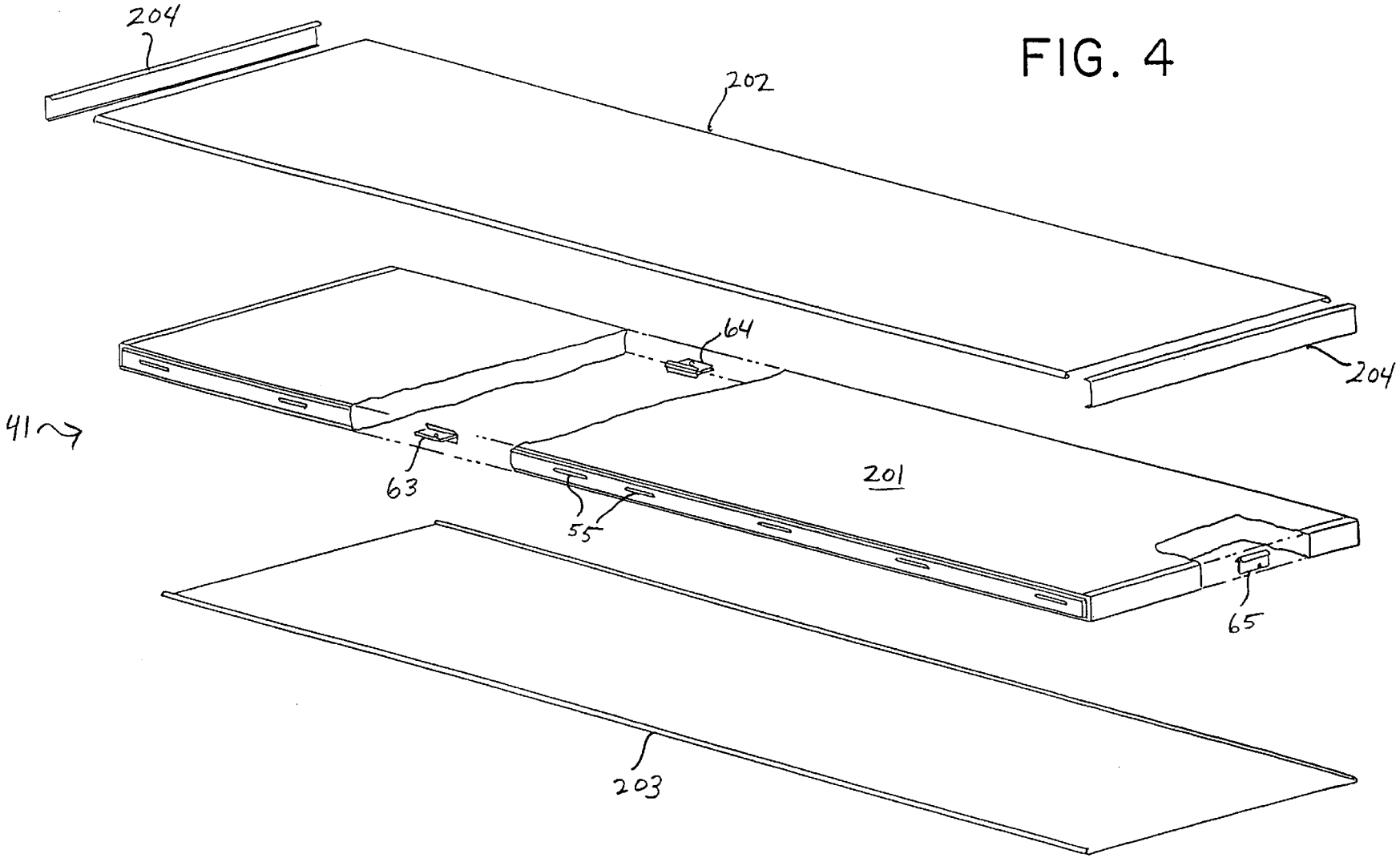
FIG. 4 is an exploded view showing the relation of the ceiling panels with the fastening mechanisms of the present invention.

FIG. 4 shows the construction of one of the ceiling panels 41 of the preferred embodiment. Ceiling panels 41 are formed by a molding process in which insulating material 201 is molded between metal skins 202, 203, and endcaps 204. Male fastening housings 63, 65 are placed in male fastening positions 55, and female fastening housing 64 in female fastening positioning (not shown in FIG. 4). Each male fastening housings 63 engages and connects to a female fastening housing on an adjacent ceiling panel, while male fastening housings 65 engage and connect to female fastening housings of a corner panel 42 or wall panel 43 (FIG. 2). Likewise, female fastening housings 64 engage and connect to male fastening housings on an adjacent abutting ceiling panel.

The remaining panels are constructed in substantially similar manners as the construction of the corner panels 42 and ceiling panels 41. In each case, the male and female fastening housing are positioned so as to engage and connect to each other when the panels are placed adjacent to one another.

The fastening housings 61, 62, 63, 64, 65, like all in the present invention, have a backing material (not shown) coated to at least one surface of the substrate used to make the fastening housing. In the preferred embodiment, all surfaces of the fastening housings have such a backer. The purpose of the backer is to improve the adherence of the fastening housings to the insulating materials, e.g., insulating material 101, 201, in the individual panels 41, 42, 43, 44. The substrates used for the fastening housings are preferably metals, and most preferably bare cold rolled steel, temper #4 with hardness range of B45 to B65. The backer may be any suitable material that more strongly adheres to the insulating material than does the substrate. A preferred backer includes a polymer material. More preferably, the backer contains a polyester. In the most preferred embodiment, the backer also contains an epoxy resin. A suitable material for the backer of the preferred embodiment is 12C126™ sold by Morton International of Chicippe, Massachusetts. The backer is preferably coated onto the substrate at a thickness of about 0.1 to about 0.5 millimeters, and most preferably at a thickness of about 0.2 to 0.3 millimeters.

The insulating materials 101, 201 may be any material capable of being molded. Preferably, the insulating material is a foam. In the most preferred embodiments of the invention, the insulating material is a urethane or polyurethane foam. A suitable material is Urethane XR1149R, sold by General Latex of Ashland, Ohio.

Figure 5:
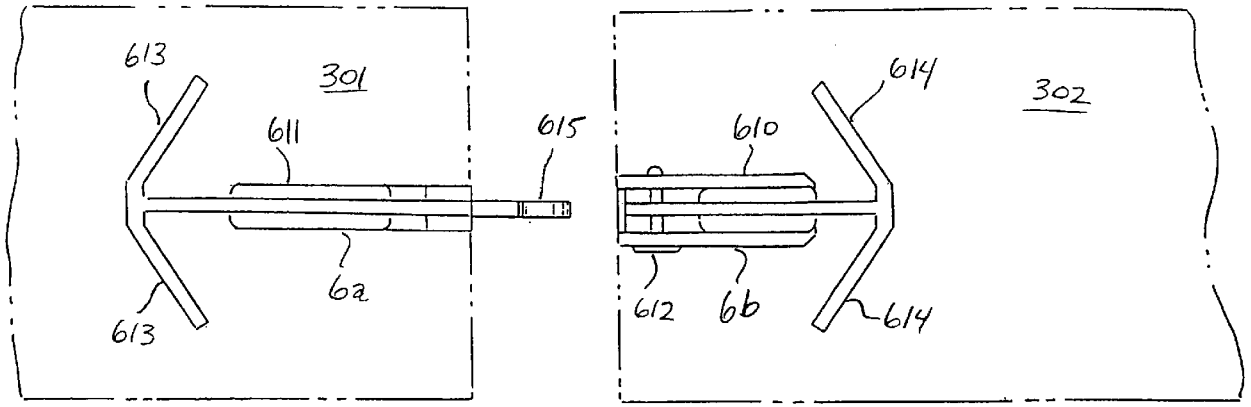
FIG. 5 is a top cross-sectional view of the male and female members of the fastening mechanism embedded in the insulating material of the refrigerator panels.
Figure 6:
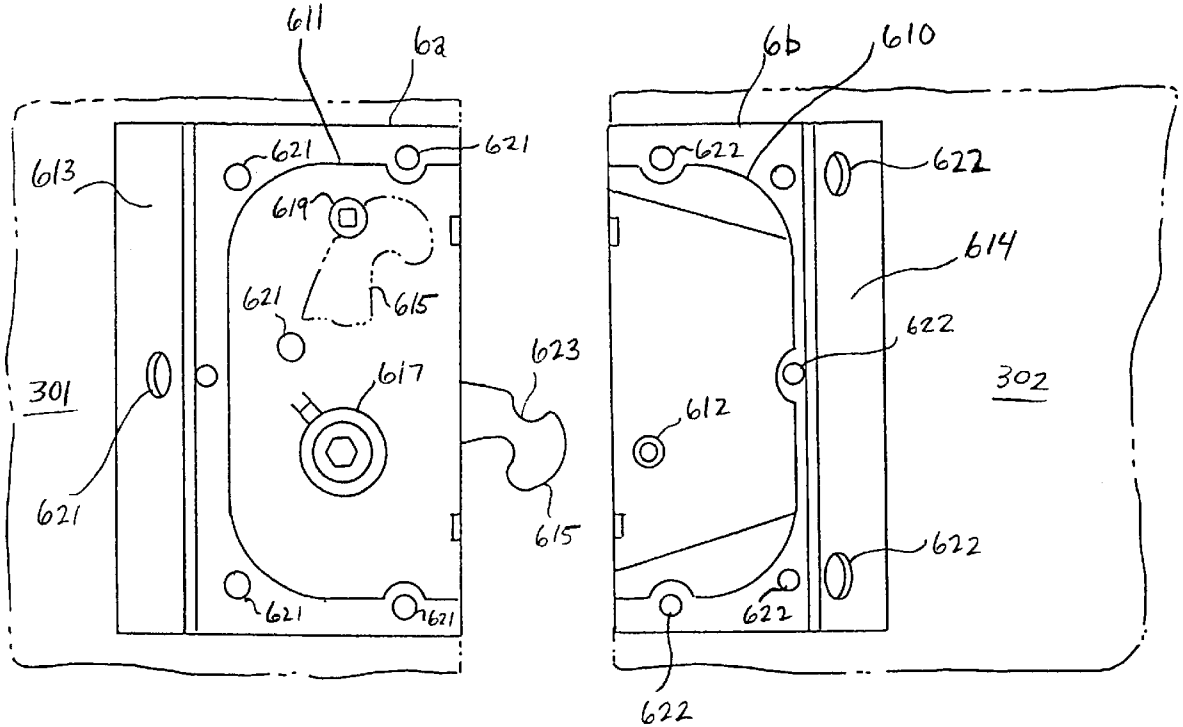
FIG. 6 is a lateral cross-sectional view of the fastening mechanism of FIG. 5 embedded in the insulating material of the refrigerator panels.

FIGS. 5 and 6 illustrate the male and female fastening housings of the preferred embodiment. FIG. 5 is top cross sectional view and FIG. 6 is a lateral cross sectional view. In FIGS. 5 and 6, male fastening housing 6*a* is embedded in the insulating material 301 of one of the panels of the refrigerator wall system 1 (FIG. 2), and female fastening housing 6*b* is embedded in the insulating material of an adjacent panel. Male fastening housing 6*a* includes a fastener casing 611 containing a rotatable hook member 615 at an engaging end of the male fastening housing 6*a*, an actuating assembly 617, and a stop pin 619. Female fastening housing 6*b* includes a fastener casing 610 containing a catch pin 612 located at an engaging end of the female fastening housing 6*b*. The hook member 615 of male fastening housing 6*a* is rotated between an open position (shown in phantom) where cut-out portion 623 of the hook member 615 rests against the stop pin 619, and a closed position as shown in FIGS. 5 and 6. When adjacent panels are placed together, the hook member 615 engages the stop pin 612 and connects the male and female fastening housings 6*a* and 6*b* together, and thereby secures the adjacent panels. The details of the operation of the actuating unit 617 and the hook member 615 are well-known in the art have been omitted here, but can be found in U.S. Pat. No. 4,512,122, the entire disclosure of which is incorporated by reference herein.

The male and female fastening housings may also include wings 613 and 614, respectively. The wings 613, 614 are located at a remote end of their respective housings opposite their engaging ends. The wings 613, 614 add to the pull-strength of their respective fastening housings in the insulation material. The male and female fastening housings 6*a* and 6*b* also may include apertures 621 and 622, respectively, to facilitate flow of the molding material around the housings 6*a* and 6*b* during the molding process.

The present invention also embodies a method for making the fastening housings to be used in the refrigerator wall system. In the method of the present invention, backing material is added to a substrate material before the substrate is stamped to form the parts needed to assembly the fastening housings. The substrate is preferably a metal, and most preferably aluminum, stainless steel, or galvanized steel. Preferably the substrate is in the form of a metal sheet or metal coil. The backer may be applied to one side of the substrate, or to all sides of the substrate. As described above, the backing material chosen must have a stronger adherence to the insulating material than the substrate has to the insulating material. Suitable backers are polymers, such as polyesters, and/or epoxy resins. Most preferred is 12C126™ from Morton International of Chicippe, Mass. The substrate may be pre-treated before receiving the coating. A suitable treating agent is bonderite #902, iron-phosphate conversion coating process, sold by Parker of Henkel Services Technical of Madison Heights, Mich.

After the backing material has been coated onto the substrate, the parts for the fastening housings are stamped and assembled according to known methods in the art.

It should be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A refrigeration system comprising:

a) a refrigeration unit;

b) a plurality of walls having an inner layer of insulating material;

c) a plurality of wall fasteners interlocking the plurality of walls, at least one surface of said fasteners in contact with the inner layer, said fasteners formed of a substrate material;

d) said at least one surface of said fasteners coated with a backer, wherein said backer comprises a material having a stronger adherence to the inner layer of insulating material than the substrate material would have to the inner layer of insulating material.

2. The refrigeration system of claim 1, wherein said backer comprises a polymer.

3. The refrigeration system of claim 2, wherein said backer comprises a polyester.

4. The refrigeration system of claim 3, wherein said backer further comprises an epoxy resin.

5. The refrigeration system of claim 1, wherein the insulating material comprises a foam.

6. The refrigeration system of claim 5, wherein said foam comprises a urethane.

7. The refrigeration system of claim 6, wherein said foam comprises a polyurethane.

8. The refrigeration system of claim 7, wherein said substrate material comprises a metal.

9. The refrigeration system of claim 8, wherein said metal is selected from the group consisting of aluminum, stainless steel, and galvanized steel.

10. The refrigeration system of claim 9, wherein said walls comprises a plurality of interlocking panels, said wall fasteners interlocking said plurality of panels.

11. A fastening mechanism for use with a refrigeration system having a plurality of interconnected walls having a foam inner layer, the fastening mechanism comprising:

a) a fastening housing formed from a metal substrate, and b) at least one surface of said fastening housing coated with a polymer backer in order to be securely bonded to the foam inner layer of at least one of the walls.

12. The fastening mechanism of claim 11, wherein said polymer backer comprises a polyester.

13. The fastening mechanism of claim 12, wherein said polymer backer further comprises an epoxy resin.

14. The fastening mechanism of claim 11, wherein said polymer backer is colorless.

15. The fastening mechanism of claim 11, wherein said polymer backer is about 0.1 to about 0.5 millimeters in thickness.

16. The fastening mechanism of claim 15, wherein said polymer backer is about 0.2 to about 0.3 millimeters in thickness.

17. The fastening mechanism of claim 16, wherein said fastening housing comprises a male housing and a female housing, said male housing engaging said female housing when said fastening member is in a closed position.

18. The fastening mechanism of claim 17, wherein said fastening housing further comprises a rotatable hook disposed within said male housing at an engaging end of the housing, and a pin disposed within said female housing at an engaging end of the housing, said hook engaging said pin when said fastening housing is in said closed position.

19. The fastening mechanism of claim 18, wherein said male housing further comprises at least one wing at a remote end of the male housing opposite said engaging end, and said female housing further comprising at least one wing at a remote end opposite said engaging end of the female housing.

20. The fastening mechanism of claim 19, wherein said male housing and said female housing each have at least one hole therein to facilitate the flow of foam around said housings.

* * * * *